US005921675A

United States Patent [19]

Zikeli et al.

[11] Patent Number: 5,921,675

[45] **Date of Patent: *Jul. 13, 1999**

[54] METHOD FOR KEEPING AND DELIVERING A HOMOGENEOUS CELLULOSE SUSPENSION

[75] Inventors: Stefan Zikeli, Regau; Friedrich Ecker, Timelkam; Ulrich Möderl, Lenzing, all of Austria

[73] Assignee: Lenzing Aktiengesellschaft, Lenzing, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/807,258

[22] Filed: Mar. 3, 1997

Related U.S. Application Data

[63] Continuation of application No. 08/460,150, Jun. 2, 1995, abandoned.

[30] Foreign Application Priority Data

Apr. 25, 1995 [AT] Austria ..... A 712/95

[51] Int. Cl.[6] ..... B01F 7/04; B01F 15/02

[52] U.S. Cl. ..... 366/186; 366/194

[58] Field of Search ..... 366/50, 184, 186, 366/194–196, 297–300; 162/57, 243

[56] References Cited

U.S. PATENT DOCUMENTS

| | | | |
|---|---|---|---|
| 1,960,692 | 5/1934 | Brown et al. | 366/186 X |
| 2,366,673 | 1/1945 | Paley | 366/186 X |
| 2,868,144 | 1/1959 | Ambrette | 366/186 X |
| 2,991,870 | 7/1961 | Griffith et al. | 366/186 X |
| 3,059,595 | 10/1962 | Locatelli | 366/186 X |
| 3,548,903 | 12/1970 | Holly | 366/186 X |
| 3,570,569 | 3/1971 | Hartley et al. | 366/186 X |
| 3,897,218 | 7/1975 | Busweiler | 366/194 X |
| 3,901,483 | 8/1975 | Lasar | 366/299 X |
| 4,139,309 | 2/1979 | Billingsley | 366/186 |
| 4,185,925 | 1/1980 | Gazzoni | 366/186 X |
| 4,246,221 | 1/1981 | McCorsley, III . | |
| 4,665,810 | 5/1987 | Falck | 366/195 X |
| 4,795,104 | 1/1989 | Rudibaugh . | |
| 5,407,268 | 4/1995 | Henrich | 366/194 X |
| 5,656,224 | 8/1997 | Zikeli et al. . | |
| 5,755,318 | 5/1998 | Zikeli et al. . | |

FOREIGN PATENT DOCUMENTS

| | | |
|---|---|---|
| A0356419 | 8/1988 | European Pat. Off. . |
| A0553070 | 1/1992 | European Pat. Off. . |
| 2595266 | 9/1987 | France . |
| 3202588 | 8/1983 | Germany . |
| A-4010676 | 10/1991 | Germany . |
| A-9406530 | 3/1994 | WIPO . |
| WO94 28217 | 12/1994 | WIPO . |

OTHER PUBLICATIONS

English language Abstract of DE–A 4,010,676.

*Primary Examiner*—Charles E. Cooley
*Attorney, Agent, or Firm*—Baker & Botts LLP

[57] ABSTRACT

A method for keeping and delivering a homogeneous suspension of shredded cellulose in an aqueous amine oxide is provided using a horizontal cylindrical vessel including a conveyor screw which is parallel to and partially coextensive with the stirring elements in the vessel.

3 Claims, 1 Drawing Sheet

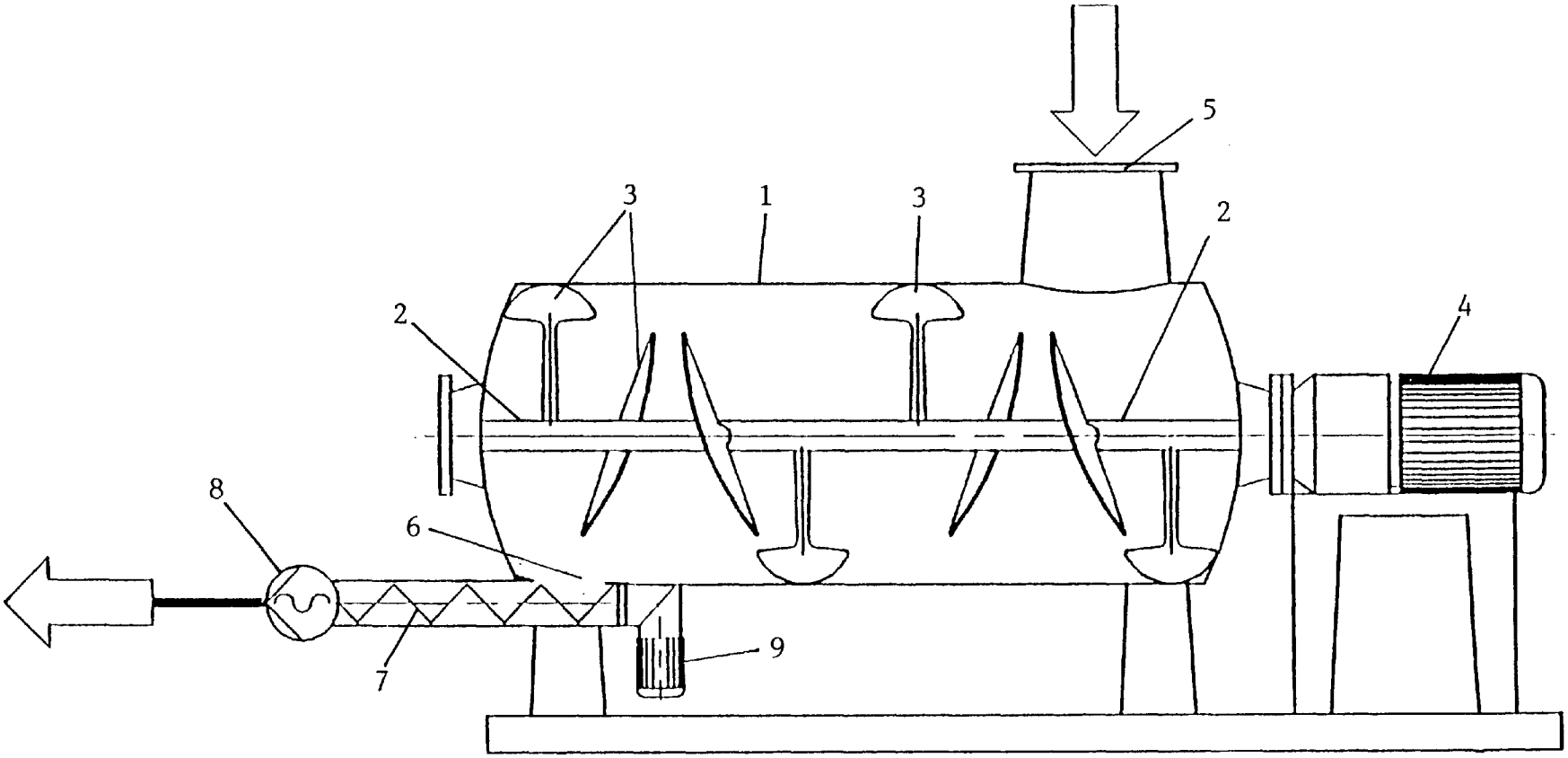
4
5
2
3
1
3
2
6
9
7
8

METHOD FOR KEEPING AND DELIVERING A HOMOGENEOUS CELLULOSE SUSPENSION

This application is a continuation of application Ser. No. 08/460.150, filed on Jun. 2, 1995, now abandoned.

BACKGROUND OF THE INVENTION

The present invention is concerned with a device for keeping and delivering a homogeneous cellulose suspension, i.e. a substantially cylindrical mixing vessel and an inlet for the homogeneous suspension, a stirring shaft having stirring elements attached thereto, said stirring shaft being arranged axially within the cylindrical mixing vessel and a discharge device for the homogeneous suspension.

For some decades there has been searched for processes for the production of cellulose moulded bodies able to substitute the viscose process, today widely employed. As an alternative which is interesting among other reasons for its reduced environmental impact, it has been found to dissolve cellulose without derivatisation in an organic solvent and extrude from this solution moulded bodies, e.g. fibres, films and membranes. Fibres thus extruded have received by BISFA (The International Bureau for the Standardization of man made fibers) the generic name Lyocell. By an organic solvent, BISFA understands a mixture of an organic chemical and water.

It has turned out that as an organic solvent, a mixture of a tertiary amine-oxide and water is particularly appropriate for the production of cellulose moulded bodies. As the amine-oxide, primarily N-methylmorpholine-N-oxide (NMMO) is used. Other amine-oxides are described e.g. in EP-A-0 553 070. A process for the production of mouldable cellulose solutions is known e.g. from EP-A-0 356 419. The production of cellulose moulded bodies using tertiary amine-oxides is generally referred to as amine-oxide process.

In U.S. Pat. No. 4,246,221, an amine-oxide process for the production of spinnable cellulose solutions using as starting material among other substances a mixture of cellulose in liquid, aqueous N-methylmorpholine-N-oxide (NMMO) is described. This is a multi-step process. First, a suspension of cellulose in the aqueous amine-oxide solution is prepared in a discontinually operated mixing device, the mixture being simultaneously heated at reduced pressure, while water is withdrawn and a first solution is prepared. Next, this first solution is kept in a tank serving as buffer vessel, then conducted to a filtration device and thereafter transformed into a mouldable solution in an extruder. Finally, the mouldable solution is spun to filaments in a forming tool, such as a spinneret, said filaments being eventually conducted through a precipitation bath.

From WO 94/28217, a process for the production of a premixture based on cellulose, wherefrom a mouldable cellulose solution may be prepared, is known. According to this process, shredded cellulose and an amine-oxide solution are introduced into a horizontal cylindrical mixing chamber exhibiting a rotor having axially spaced stirring elements. The mixture is stirred in the mixing chamber by turning the rotor at a rate of from 40 to 80 revolutions per minute. Preferably, the mixture in the mixing chamber is kept at a temperature of above 65° C. In WO 94/28217, there also is described a funnel-shaped tank which is vertically disposed and wherein stirring arms are provided. In this tank, the premixture is to be kept in a homogeneous state. The homogeneous premixture is removed by means of reciprocating pumps.

As mentioned above, the amine-oxide process involves a number of steps extending from the shredding of the cellulose, the preparation of the cellulose suspension, optionally a subsequent further homogenization of the cellulose suspension, and the transformation of the homogeneous cellulose suspension into a mouldable cellulose solution to the moulding process itself, i.e. the production of fibres, films or other moulded bodies. Since each of the process steps is required to deliver its corresponding product in a constant quality, it is desired to operate each of the process steps continuously and, if possible, without interruption. Still, when an interruption occurs at one step, for instance because the forming tool is exchanged or the device wherein the cellulose suspension is produced is stopped for a short time, it is the endeavour of the expert that, if possible, the other process steps are not affected by this short-time interruption. Up to now however, this objective has not yet been satisfactorily attained.

SUMMARY OF THE INVENTION

Thus it is the object of the present invention to carry out the amine-oxide process in such a way that the process as a whole is able to overcome short-time interruptions and that a short-time interruption of one step of the process does not simply an interruption of the other steps.

According to the invention, this object is attained by providing a device exhibiting the following features:

(1) a substantially cylindrical mixing vessel and an inlet for the homogeneous suspension, (2) a stirring shaft having stirring elements attached thereto, said stirring shaft being arranged axially within the cylindrical mixing vessel and keeping the suspension introduced through the inlet in a homogeneous state by means of rotation, (3) a discharge device for the homogeneous suspension, and is characterized in that the discharge device is a conveyor screw attached to the bottom of the mixing vessel, the conveyor screw being connected to the interior of the mixing vessel.

The invention is based on the finding that the object of the present invention can best be attained by means of a vessel able to serve as a buffer for the homogeneous cellulose suspension, on the one hand always containing a certain amount of homogeneous suspension which when interrupting the production of suspension for a short time serves as a reserve and whereby during the time of interruption cellulose solution may be produced and the forming tool may be fed, so that it is not necessary to interrupt e.g. the production of the fibres. On the other hand, the vessel according to the invention must have a certain void in order to be able to receive additional homogeneous suspension, so that it is not necessary to interrupt the production of the suspension during a short-time stop of the spinning operation, e.g. when exchanging the spinneret.

When keeping homogeneous suspensions of cellulose in an aqueous amine-oxide solution, a particular problem consists in avoiding a segregation of the homogeneous suspension, i.e. a separation of the cellulose from the liquid phase. This risk also occurs when the homogeneous suspension is delivered to the subsequent process step. Both problems have been solved by means of the device according to the invention. It has been shown that a separation of the cellulose at the discharge step can be successfully avoided when a conveyor screw connected to the interior of the mixing vessel is provided for discharging. The input end of the conveyor screw is in parallel to and partially coextensive with at least a portion of the stirring elements. Thus the catchment zone of the conveyor screw is to open directly into the interior of the mixing vessel.

In the device according to the invention, it is also possible to avoid the sticking of cellulose particles impregnated by amine-oxide solution to the vessel wall or the formation of agglomerates. It is decisive to keep the suspension constantly moving.

Furthermore, it has been shown that in the device according to the invention no segregation of auxiliary agents such as stabilizers, dispersants, auxiliary spinning agents, reactivity-improving reagents, incorporation media of an inorganic or organic nature (barite, activated carbon, $SiO_2$, CMC, modifiers (polyethyleneglycoles) and other polymers such as nylon; dyes contained in the suspension; will occur. This is of decisive importance for these auxiliary agents to develop their maximum effect. A preferred embodiment of the device according to the invention is characterized in that stirring elements are provided which are arranged such that they sweep over the discharge outlet.

Another appropriate embodiment of the device according to the invention consists in that the conveyor screw is provided diametrically opposed to the inlet.

It has proven advantageous to design the device according to the invention in such a way that the ratio of the receiving capacity of the discharge element to the receiving capacity of the cylindrical mixing vessel amounts to at least 1:100.

BRIEF DESCRIPTION OF THE DRAWING

By means of the attached drawing, an embodiment of the device according to the invention will be described in more detail.

FIG. 1 shows a cross-sectional side view of a mixing vessel and discharge device in accordance with the invention.

DETAILED DESCRIPTION OF THE PREFERRED EMBODIMENTS

FIG. 1 shows a longitudinal section of a horizontally mounted mixer consisting substantially of a cylindrical vessel 1 having a double-jacket for indirect heating (not represented) and a rotor 2 having stirring blades 3 attached thereto being arranged centrically within the vessel 1. Rotor 2 is driven by means of a motor 4.

The homogeneous cellulose suspension is introduced into the cylindrical vessel 1 through inlet 5, seized by the transport blades 3 and constantly mixed and kept moving in the interior of vessel 1 by means of stirring blades 3.

The homogeneous suspension is removed from vessel 1 by means of the conveyor screw 7 driven by motor 9 and conducted by means of a pump 8 for instance to a device (not shown) wherein the suspension is transformed into a mouldable solution in a continuous manner. Appropriately, a thin-film treatment apparatus is employed for this procedure. Such a process is known from EP-A-0 356 419.

The catchment zone of conveyor screw 7 is directly connected to the interior of vessel 1. Conveniently, the conveyor screw 7 is attached by flange to the bottom of vessel 1, and the outlet 6, that is to say the connection between the catchment zone of conveyor screw 7 and the interior of vessel 1, may have square or rectangular shape.

At normal operation, approximately half of vessel 1 is filled with homogeneous suspension.

A device disposed as a mixer and consisting substantially of vessel 1, rotor 2 having stirring elements 3 attached thereto, motor 4 and inlet 5, is commercialized by the company Draiswerke GmbH, Mannheim, Germany, under the name of turbulent mixer of the KT 1000 FM I type. In this turbulent mixer however, the outlet is provided centrically as a kind of flap at the lower end of the bulge of the vessel. This kind of removal of mixed material is not appropriate for homogeneous cellulose suspensions, since the mixed material would segregate when removed. On the contrary, segregation is successfully avoided by means of the conveyor screw provided according to the invention.

We claim:

1. A method for keeping and delivering a homogeneous suspension of shredded cellulose in an aqueous amine oxide comprising the steps of:

providing a homogeneous suspension of shredded cellulose in an aqueous tertiary amine oxide;

providing a device including a substantially horizontal cylindrical mixing vessel having an inlet, a stirring shaft having stirring elements attached thereto, said stirring shaft arranged axially with said mixing vessel, a discharge device including a discharge outlet located at the bottom of the mixing vessel and a conveyor screw having an input end and an output end attached to the bottom of the mixing vessel, the conveyor screw being diametrically opposed to the inlet of the inlet of the mixing vessel, the input end of the conveyor screw being in parallel to and partially coextensive with at least a portion of the stirring elements such that the input end of the conveyor screw is in contact with the interior of the mixing vessel;

introducing the homogeneous suspension into the inlet of the mixing vessel;

mixing the homogeneous suspension by rotating the stirring elements;

contacting the homogeneous suspension with the input end of the conveyor screw; and conveying the homogeneous suspension out of the mixing vessel using the conveyor screw thereby avoiding segregation of the homogeneous suspension.

2. A method according to claim 1, wherein said stirring elements are arranged such that they sweep over the discharge outlet.

3. A method according to claim 1 or claim 2, wherein the ratio of the receiving capacity of the discharge, device to the receiving capacity of the cylindrical mixing vessel is at least 1:100.

* * * * *

UNITED STATES PATENT AND TRADEMARK OFFICE

CERTIFICATE OF CORRECTION

PATENT NO. : 5,921,675

DATED : July 13, 1999

INVENTOR(S) : STEFAN ZIKELI ET AL.

It is certified that error appears in the above-identified patent and that said Letters Patent is hereby corrected as shown below:

Column 4, claim 3, line 54, "discharge, device" should read --discharge device--

Signed and Sealed this

Tenth Day of April, 2001

*Attest:*

Nicholas P. Godici

NICHOLAS P. GODICI

*Attesting Officer*

*Acting Director of the United States Patent and Trademark Office*